US006491412B1

(12) United States Patent
Bowman et al.

(10) Patent No.: US 6,491,412 B1
(45) Date of Patent: Dec. 10, 2002

(54) LED DISPLAY

(75) Inventors: Mark Bowman, Lexington, VA (US); Steve Flaherty, Lexington, VA (US); Ferenc Mohacsi, Muskego, WI (US)

(73) Assignee: Everbrite, Inc., Greenfield, WI (US)

( * ) Notice: Subject to any disclaimer, the term of this patent is extended or adjusted under 35 U.S.C. 154(b) by 0 days.

(21) Appl. No.: 09/608,895

(22) Filed: Jun. 30, 2000

Related U.S. Application Data

(60) Provisional application No. 60/156,730, filed on Sep. 30, 1999.

(51) Int. Cl.[7] ..... F21V 21/00; G09F 13/00

(52) U.S. Cl. ..... 362/249; 362/812; 362/247; 40/563

(58) Field of Search ..... 362/249, 800, 362/560, 247, 297, 298, 301, 812, 235, 244, 245, 246, 299, 346, 806, 240, 250, 252; 40/584, 563, 570, 583, 550, 544

(56) References Cited

U.S. PATENT DOCUMENTS 3,746,853 A * 7/1973 Kosman et al. ..... 362/301
4,134,096 A * 1/1979 Denes ..... 338/195
4,439,818 A * 3/1984 Scheib ..... 362/250
4,682,147 A * 7/1987 Bowman ..... 40/570
5,105,568 A * 4/1992 Branning ..... 40/570
5,167,556 A 12/1992 Stein
5,469,347 A 11/1995 Duve et al.
5,803,579 A * 9/1998 Turnbull et al. ..... 362/231

* cited by examiner

*Primary Examiner*—Sandra O'Shea
*Assistant Examiner*—Bao Truong
(74) *Attorney, Agent, or Firm*—Michael Best & Friedrich LLP

(57) ABSTRACT

An illuminated sign having an LED as a light source as claimed. A housing has a plurality of internal surfaces wherein at least one of the internal surfaces is a translucent surface. A reflective layer covers each of said internal surfaces except the translucent surface. At least one LED is positioned between the internal surfaces such that the illumination field of the LED is in a direction substantially opposite that of the translucent surface.

37 Claims, 9 Drawing Sheets

LED DISPLAY

This application claims the benefit of Provisional Application No. 60/156,730 filed Sep. 30, 1999.

BACKGROUND

This invention relates to illuminated displays. More particularly, the invention relates to an illuminated sign using light emitting diodes (LEDs) as light sources.

Typically, illuminated signs use gas discharge lighting, such as neon. Also, it is common for illuminated signs to be illuminated by incandescent or fluorescent lamps. Both gas discharge and incandescent lamps have disadvantages. Incandescent lamps operate at a very high temperature, and gas discharge lamps require high voltage.

Further, incandescent lamps have a short life and run relatively inefficiently. Driving an incandescent lamp expends a great deal of energy for the level of brightness achieved. Gas discharge lamps are typically fragile and require an expensive ballast or power supply for operation.

Some have attempted to overcome the deficiencies of gas discharge or incandescent lamps in signs by using LEDs. In such signs, the LEDs typically face outward toward the observer. Because LEDs are a highly intense point light source, such signs tend to result in an uneven illumination of the sign, where areas of brightness or "hot spots" are surrounded by darker areas. Some have tried placing a diffuser in front of the sign to diffuse the inner light. Nevertheless, the sign still has uneven illumination. Thus, it is desirable to have an efficient and safe light source that results in even illumination of a sign.

SUMMARY OF THE INVENTION

Accordingly, the present invention is an energy-efficient, safely designed, evenly illuminated sign. The sign includes a housing having a plurality of internal surfaces, one of the internal surfaces being translucent. All of the internal surfaces except the translucent surface are diffusely reflective. At least one LED is positioned between the internal surfaces, where the LED is positioned such that the direction of the illumination field of the LED is substantially opposite to the translucent surface.

Accordingly, it is a feature and advantage of the invention to provide a highly efficient illumination source for a sign.

It is another feature and advantage of the invention to provide a safe illuminated sign.

It is another feature and advantage of the invention to provide an illuminated sign that provides even illumination over all portions of the sign.

It is another feature and advantage of the invention to provide an illuminated sign having a light source with a long light life.

It is another feature and advantage of the invention to provide an illuminated sign that is inexpensive and easy to manufacture.

Other features and advantages of the invention will become apparent to those skilled in the art upon review of the following detailed description, claims and drawings.

Figure 1:
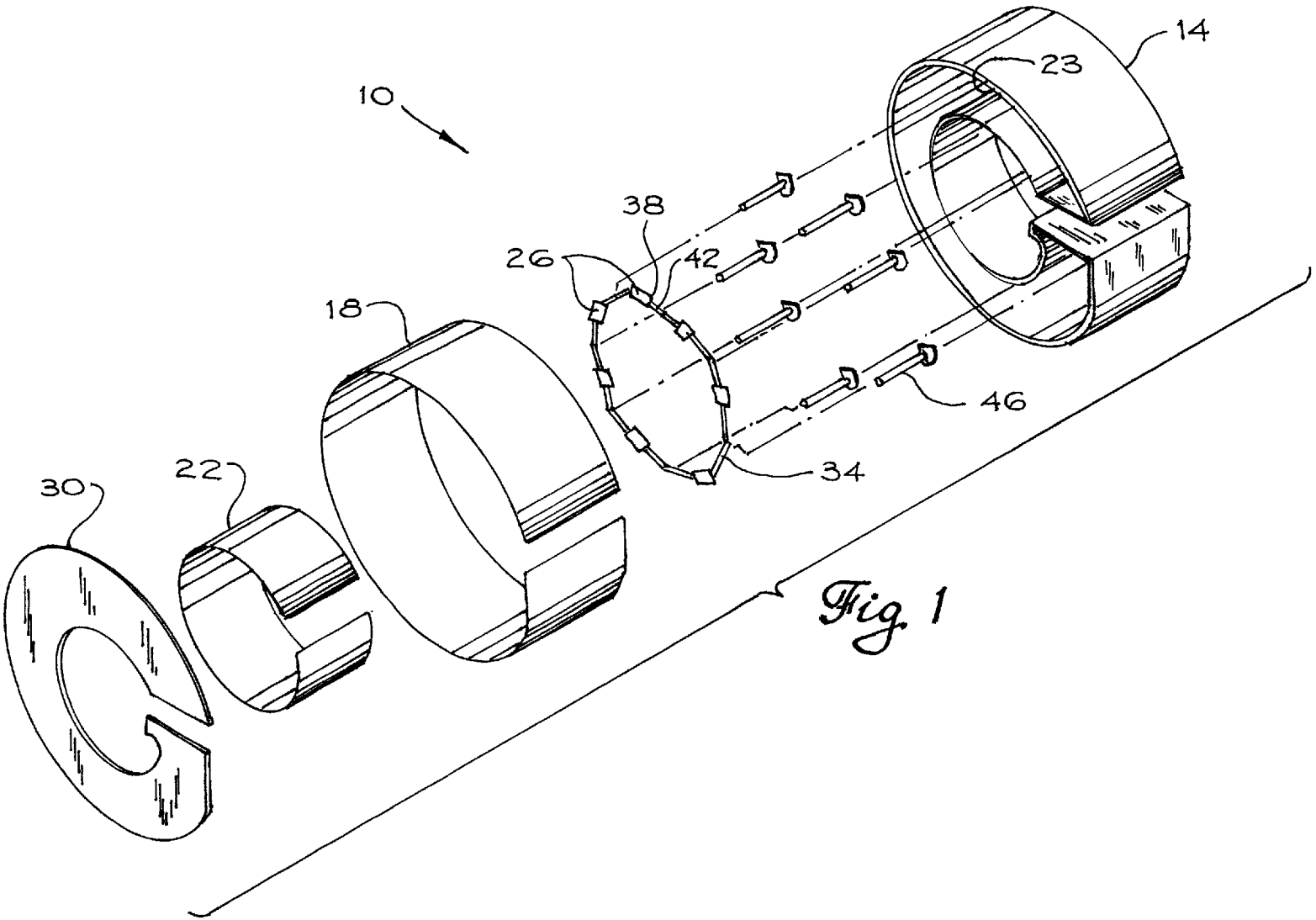
FIG. 1 is an exploded view of a first embodiment of an illuminated sign.

Before the invention is explained in detail, it is to be understood that the invention is not limited in its application to the details of the construction and arrangement of the components set forth in the following description or illustrated in the drawings. The invention is capable of other embodiments and is carried out in various ways. Also, it is understood that the phraseology and terminology used herein is for purpose of description and should not be regarded as limiting.

DETAILED DESCRIPTION

Figure 9:
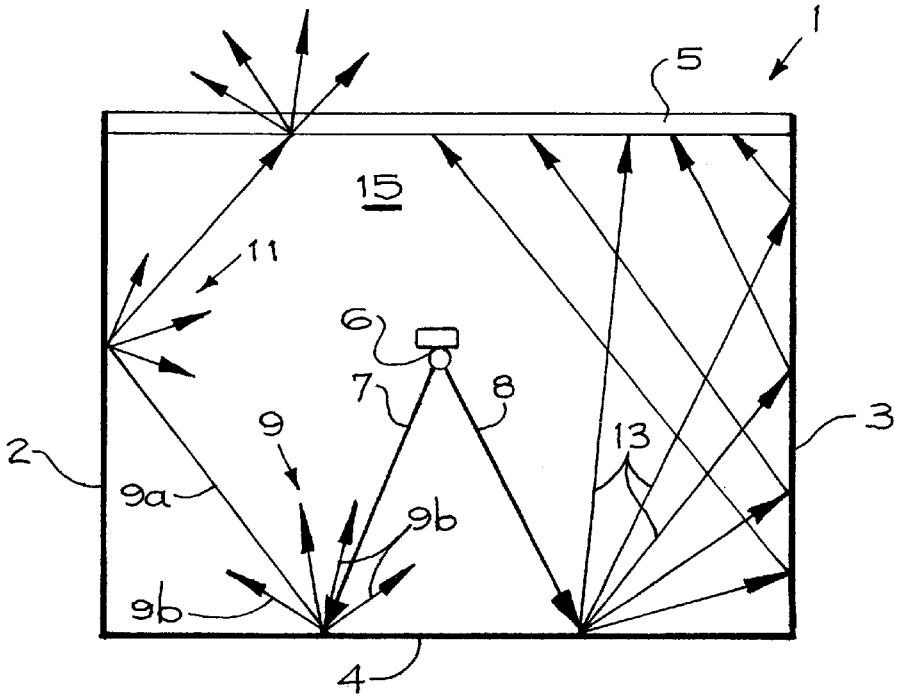
FIG. 9 is a schematic diagram illustrating some of the basic concepts of the invention.

FIG. 9 depicts some of the basic principles of the invention, particularly the manner in which dark spots and bright or hot spots are eliminated using the present invention. In FIG. 9, a display or sign 1 has a pair of opposed side surfaces 2 and 3, a back surface 4, a translucent front surface 5 and a back-facing light emitting diode (LED) 6. In the version depicted in FIG. 9, each of the side and rear surfaces are diffusely reflective, although one or more of these surfaces could also be translucent. Front surface 5 is itself either diffusely translucent or has a diffuser adjacent to it to further diffuse the output light.

Light rays emitted from LED 6, represented by arrows 7 and 8, are diffusely reflected off of back surface 4 and are split into rays having the same color but lower intensities than rays 7 and 8. For example, ray 7 may be split into rays 9, some of which (rays 9*a*) in turn are reflected off of side surface 2 and further split into rays 11. Rays 11 are either reflected off of side surface 3, back surface 4, or are directly output through translucent front surface 5. Other rays 9*b* are reflected off of side surfaces 2 or 3 or are directly output through translucent surface 5. Similarly, ray 8 is reflected off of back surface 4 and is split into rays 13, which in turn are reflected off of side surface 3 or directly output through translucent front surface 5.

In short, it is apparent that light emitted from LED 6 fills cavity 15 of sign 1 due to the rear-facing orientation of the LED and the use of diffusely reflective surfaces. This eliminates dark spots, which would otherwise appear in the position of the LED and hot spots, which, if specular reflectors were used, would otherwise appear where rays 7 and 8 strike the reflective surfaces.

FIG. 1 is an exploded view of an illuminated sign 10. Sign 10 comprises a housing 14, side reflective layers 18 and 22, a back reflective layer 23 on the back internal surface of sign 10, LED 26 and a translucent surface 30. FIG. 1 illustrates the letter "G", although it is contemplated that the sign may take the form of any character, symbol, design, or combinations thereof. The coatings 18, 22 and 23 cover the internal surfaces of the housing 14. The reflective layers 18, 22 and 23 are made of highly diffusely reflective material, such as stretched polyethylene, or a flat finish paint made of titanium dioxide. In a preferred embodiment, the highly diffusely reflective material used is WHITESTAR™ made by W.L. Gore, Inc. of Elkton, Md. It will be readily understood by one of ordinary skill in the art that the inner surface of housing 14, itself, may be diffusely reflective, eliminating the need for adding separate diffusely-reflective coatings 18, 22, and 23. Translucent surface 30 is also a diffuser and may be colored to yield output light having a desired color.

The LEDs 26 are positioned within the housing 14 such that the illumination field of the LEDs is pointed in substantially an opposite direction of the translucent surface 30 toward back reflective layer 23. As such, each LED produces a cone of illumination towards the reflective layers 18, 22 and 23. The light emanating from the LEDs 26 bounces off the reflective layers 18, 22 and 23, back towards the translucent surface 30. Thus, the light emanating from the translucent layer 30 appears evenly distributed. That is, all parts of the translucent surface 30 appear to have substantially the same level of brightness.

In one embodiment, LEDs 26 are interconnected by supply and ground wires 38 and 42 along a transparent substrate 34. Transparent substrate 34 is connected to supports 46. LEDs 26 may protrude through the substrate 34, or be attached by an epoxy or solvent, or by other bonding method. Supports 46 are transparent or reflective and are mounted directly on housing 14. In an alternate embodiment, LEDs 26 do not utilize substrate 34, but instead the LEDs or the wires are mounted directly onto supports 46 and are interconnected by supply line and ground wires 38 and 42.

Transparent substrate 34 is formable and bendable into any shape to accommodate any desired character or symbol. The pins of each LED 26 protrude through substrate 34 to interconnect to supply and ground wires 38 and 42. The sign may appear to be brighter or dimmer, as desired, based on the concentration of light sources per given area. Further, substrate 34 may be formed into zigzag shapes having few or many turns to increase the concentration of light per given area.

LED 26 may be of any type capable of being mounted on a surface. In a preferred embodiment, round or square LEDs of 3 mm and 5 mm are used, such as the high brightness ("Superflux") LED made by Ajilent Technologies of Palo Alto, Calif.

Figure 2:
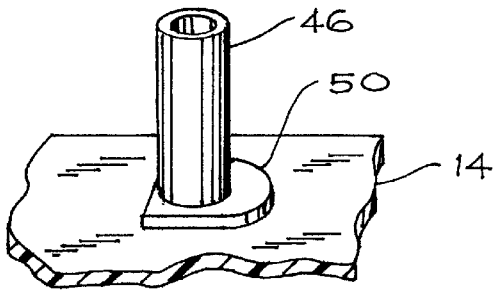
FIG. 2 is a perspective view of a support member used to suspend the light source.

FIG. 2 illustrates a perspective view of a support member used to suspend the light source. Support 46 may have a base member 50 affixed to support 46 onto housing 14. Preferably, support 46 and base member 50 are transparent. Support 46 may suspend LED 26, transparent substrate 34 or even wires 38 and 42 if no substrate is used.

Figure 3:
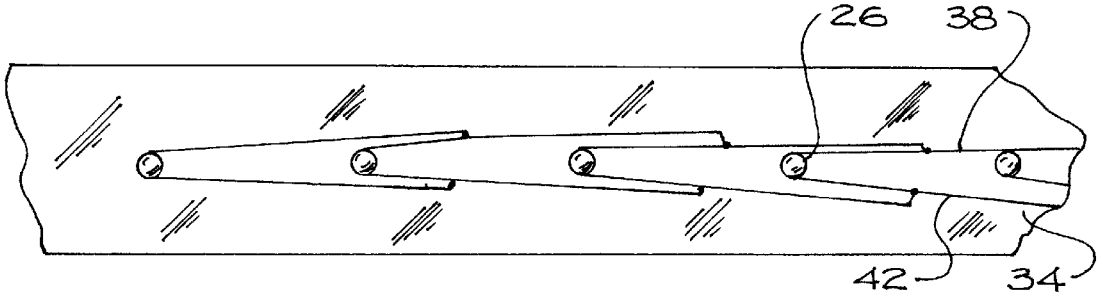
FIG. 3 is a top view of LEDs interconnected by supply and ground wires.
Figure 3A:
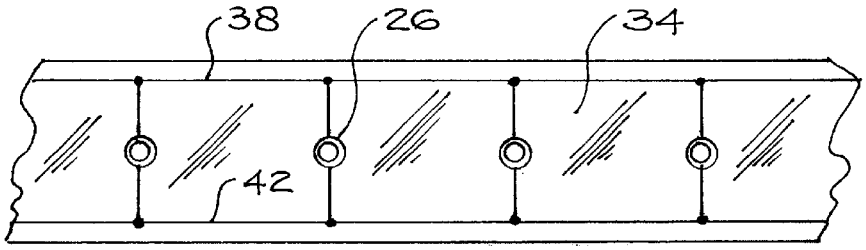
FIG. 3A is a top view, similar to FIG. 3, of LEDs interconnected by supply and ground wires in a slightly different configuration than FIG. 3.

FIG. 3 illustrates a top view of LED 26 interconnected by supply and ground wires 38 and 42. FIG. 3A illustrates a slightly different wiring configuration than is shown in FIG. 3, but it will be readily understood by one of ordinary skill in the art that the configuration shown in FIG. 3A is functionally identical to the one shown in FIG. 3. Referring to both FIGS. 3 and 3A, power supply line 38 is electrically interconnected between each LED 26. Similarly, ground wire 42 is electrically interconnected between each LED 26. It will be readily understood by one of ordinary skill in the art that LEDs 26 may be connected to supply and ground wires 38 and 42 by a number of different methods, including spot welding, soldering, or wire wrapping, wherein the prongs of the LED are wrapped with a thin wire. While FIG. 3 illustrates a parallel wiring arrangement, each LED 26 can be connected in a series or combination series/parallel arrangement as well. Use of a stronger or thicker wire for supply and ground wires 38 and 42 may be sufficient to support to suspend each LED 26 without the use of a substrate.

Figure 6:
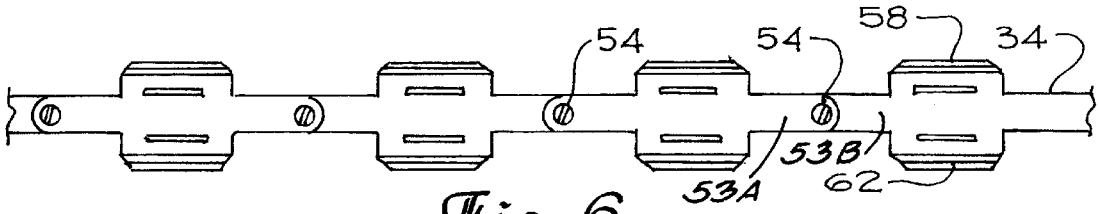
FIG. 6 is a top view of a substrate according to a first embodiment used to support the LEDs.
Figure 7:
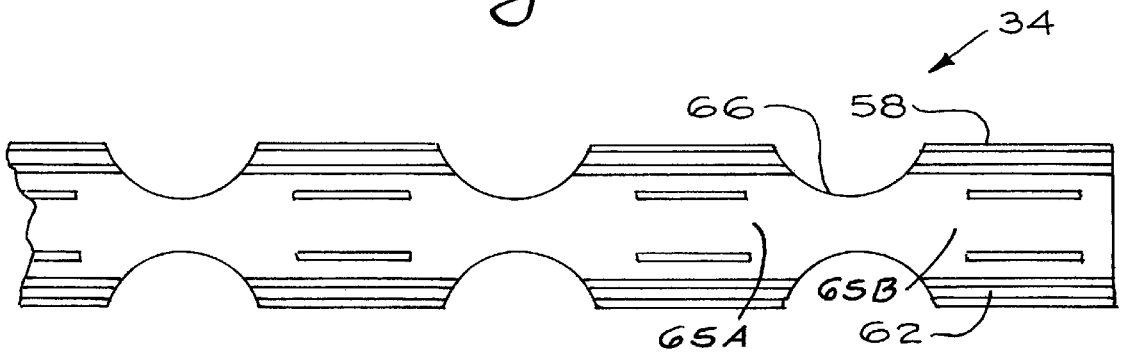
FIG. 7 is a top view of a second embodiment of a substrate used to support LEDs.

FIG. 6 illustrates a top view of an alternate embodiment of transparent substrate 34. Segments (e.g., first segment 53A and second segment 53B) of transparent substrate 34 are interconnected by pivotable rivets 54. Use of rivets 54 allows substrate 34 to be formed into various shapes and characters. Thus, use of such a substrate is versatile in that the substrate 34 can be used for virtually any character, symbol or design. Rivets 54 are preferably made of nylon or a transparent material. Each segment of substrate 34 may contain guides 58 and 62 which are used to guide and retain power supply and ground wires 38 and 42. Similarly, FIG. 7 illustrates a top view of an alternate substrate 34. Again, guides 58 and 62 may be used to guide the power supply and ground wires 38 and 42. In FIG. 7, each segment (e.g., first segment 65A and 65B) of the substrate contains a curved section 66, which allows the substrate to be formed without the need for rivets.

Figure 4:
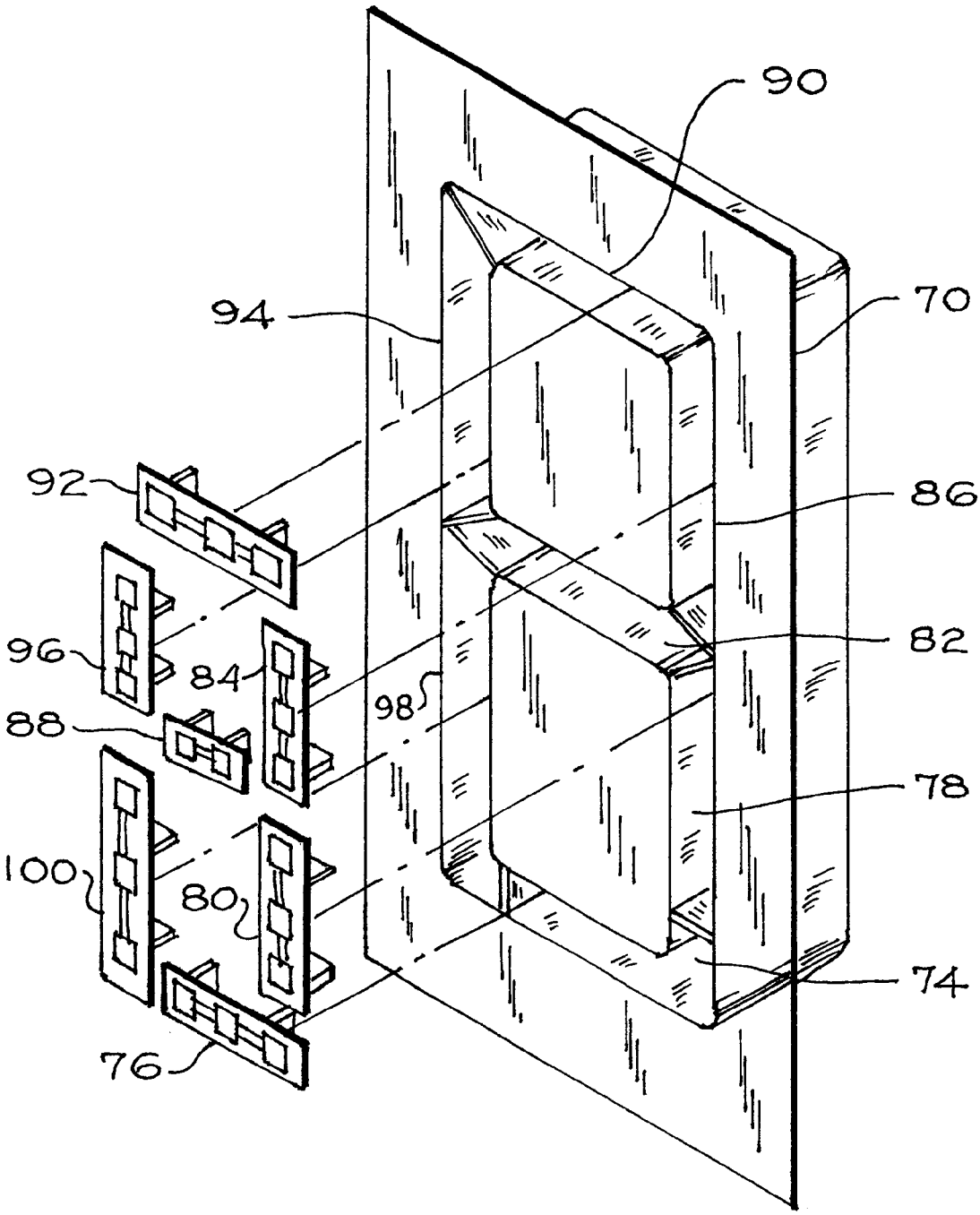
FIG. 4 is an exploded view of a segmented illuminated sign.

FIG. 4 illustrates another embodiment of the invention as individual segments within a sign are illuminated by separate LED sections. Housing 70 is divided into individual segments cavities 74, 78, 82, 86, 90, 94 and 98. Each segment cavity has a corresponding block of one or more LED segments 76, 80, 88, 84, 92, 96 and 100. Each LED segment is transparent. Each LED segment 76, 80, 84, 88, 92, 96 and 100 is connected through connectors having lead wires which extend exterior through the bottom of its respective cavity allowing it to be plugged into a circuit board. This arrangement may be used, for example, in a scoreboard sign where each numerical character is comprised of a plurality of distinct LED segments that may be individually activated. As illustrated in FIG. 4, the illumination field of each LED faces the back wall of its respective segment cavity. Each cavity is coated with a diffusely reflective material, as described with respect to FIG. 1. The light from the LED segments reflects off the interior back and side walls of the cavity to the translucent surface.

Figure 5:
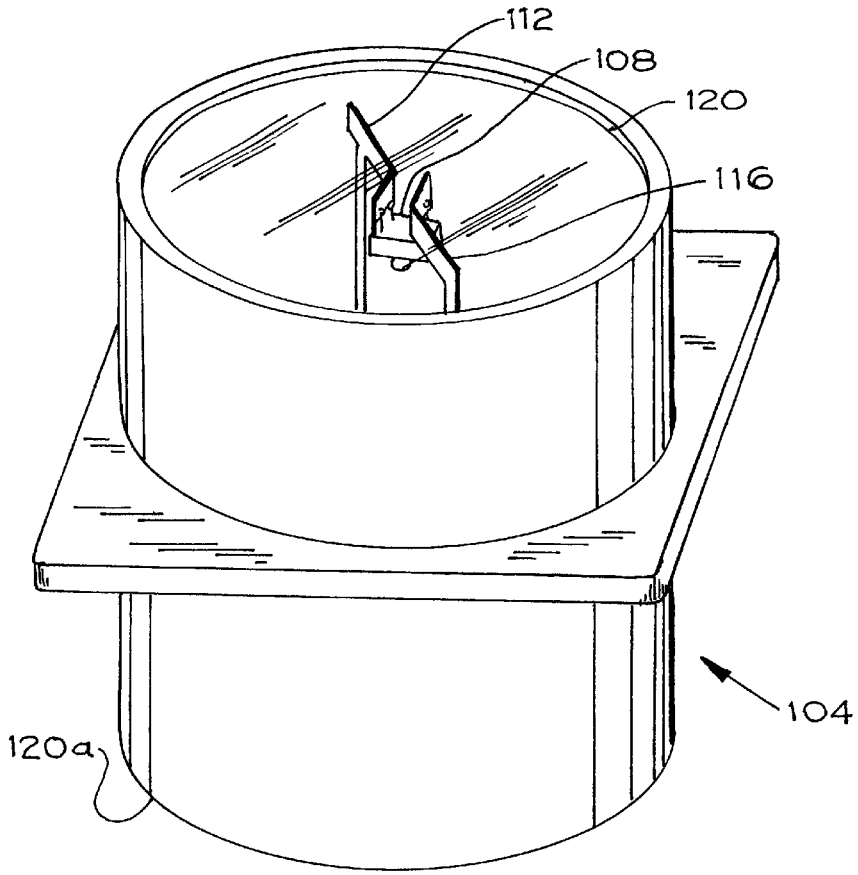
FIG. 5 is a perspective view of an individual segment or pixel of an illuminated sign.

FIG. 5 illustrates an alternate embodiment of a pixel or individual segment housing 104. The round housing 104 contains an individual LED 108 suspended by supports 112 and 116. The inner surface of housing 104 is coated with a highly diffusely reflective layer 120. The LED points in a direction opposite of the viewing surface, and thus points towards the rear wall portion 120*a* of diffusely reflective surface 120 within housing 104.

Figure 8:
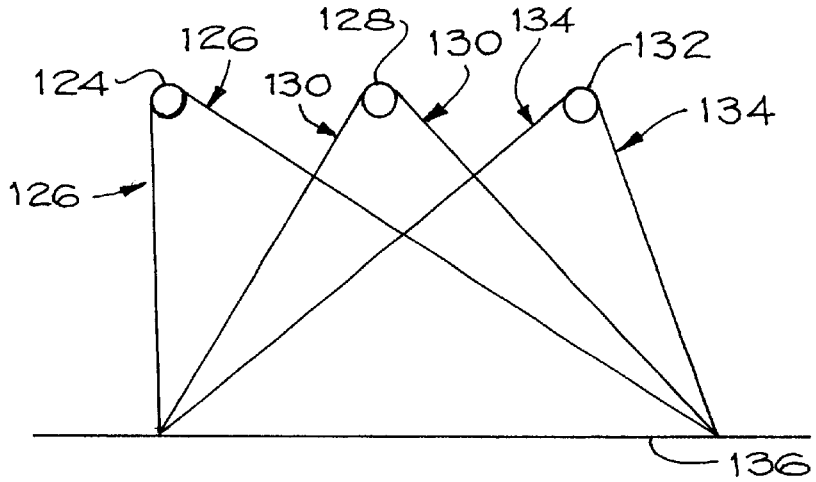
FIG. 8 is a diagram illustrating multiple LEDs having the same reflective footprint.

FIG. 8 is a diagram illustrating multiple LEDs having the same illumination field. Each LED 124, 128 and 132 has a respective illumination field 126, 130 and 134. Each illumination field 126, 130 and 134 illuminates the same region of the reflective layer 136 in housing 104. Different colors may be used as LEDs 124, 128 and 132. By having the same overall illumination field, additional colors may be created by using different color LEDs and different light intensities. Because the different LEDs initially reflect off of the same portion of reflective layer 136, the output light is well blended. The width of each illumination field may be adjusted depending upon the effect desired. A wider shaped illumination field results in decreased efficiency, as the light intensity over a given area decreases. In one embodiment, the illumination field is in the range from about 5° to about 60°, preferably about 45°. Further, each individual LED 124, 128 and 132 may have built-in refractors to alter the illumination field as desired.

Figure 10:
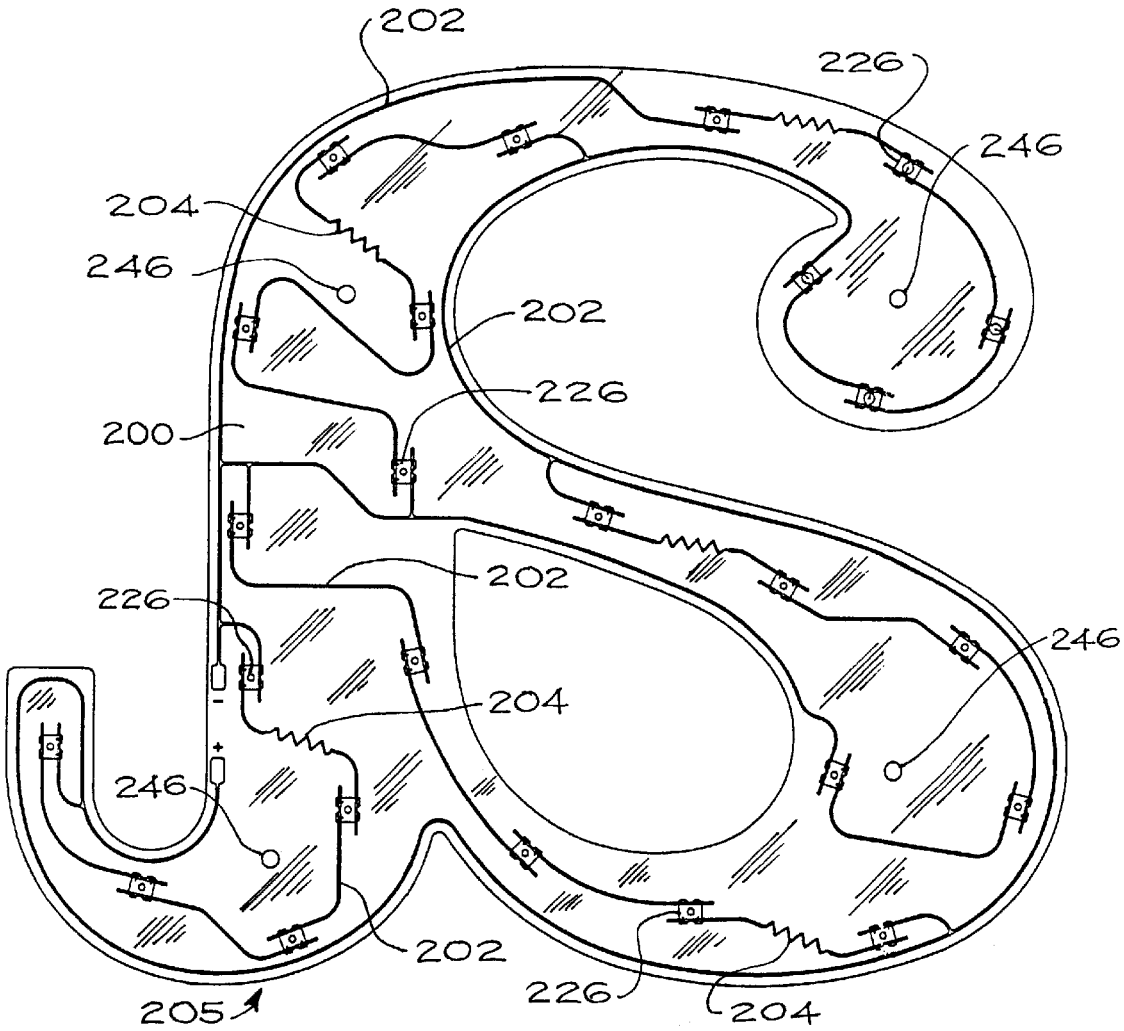
FIG. 10 is a rear view of a substrate according to a third embodiment supporting both LEDs and resistors.
Figure 11:
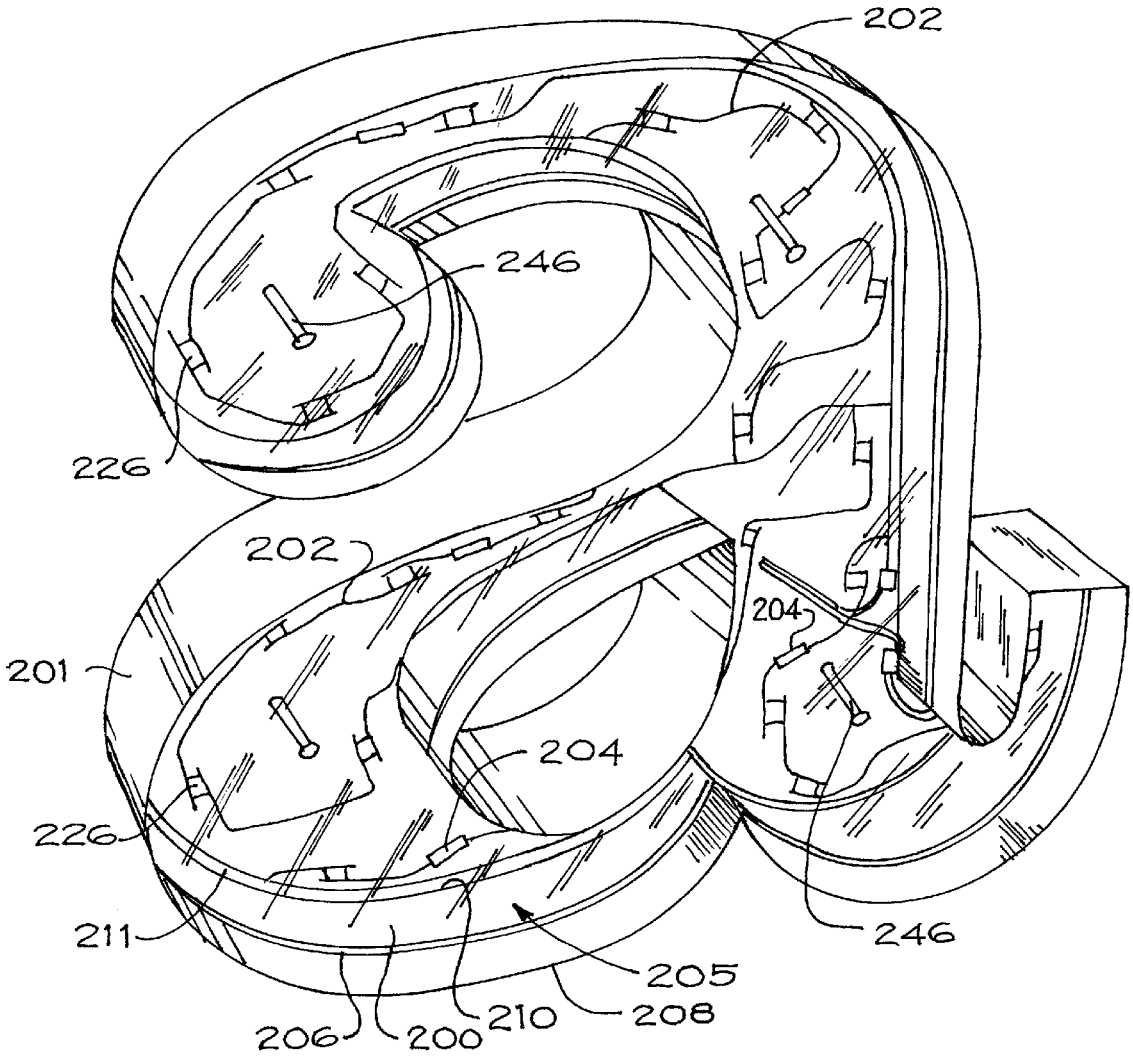
FIG. 11 is a perspective view of a partially assembled sign, showing the substrate of FIG. 10 positioned within a sign housing.
Figure 12:
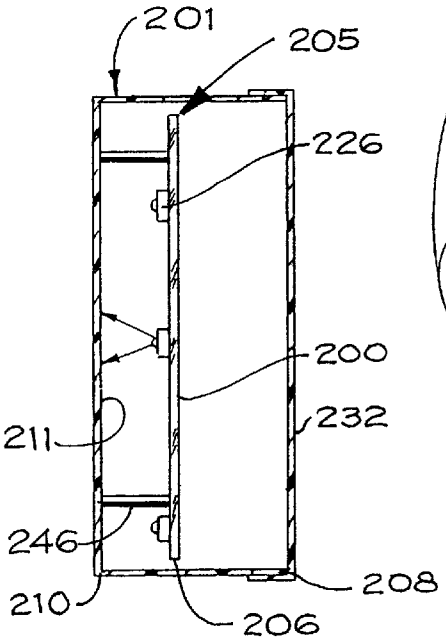
FIG. 12 is a cross-sectional side view of a sign according to the third embodiment of the present invention, showing the substrate positioned within a sign housing with the LEDs facing towards the back of the housing.

In still another embodiment of the present invention, as shown in FIGS. 10–12, in lieu of substrate 34 (FIGS. 3 and 6), a substrate sheet 200 is mounted on supports 246. Substrate sheet 200 may take any shape. As shown in FIGS. 10 and 11, substrate 200 is formed as a lower case letter "a". LEDs 226 may then be mounted in any desirable location on substrate 200. Once LEDs 226 are mounted on substrate 200, a conductive ink 202 (e.g. silver ink, copper ink, nickel-based ink, or any substance suitable for creating an electrical tracing) electrically connects the LEDS to a power source. Conductive ink 202 may be silk screened or printed onto substrate 200 to connect LEDs 226 to each other and/or to the power source. In this way, LEDs 226 may be easily mounted in any desired location within a particular sign. This embodiment allows for easy assembly (including robotic assembly) in that, after (or even before) LEDs 226 are mounted to substrate 200, conductive ink 202 may simply be applied to substrate 200 between the various LEDs 226. Robotic application of conductive ink 202 would be particularly advantageous in cases of high repeatability in which multiple signs utilizing the same electrical tracing pattern are desired.

It will be readily apparent to one of ordinary skill in the art that LEDs 226 may be located in any desirable location on substrate 200, including varying the spacing between, and number of, LEDs 226. Varying the number and spacing of LEDs 226 will accordingly vary the light intensity of the sign. Additionally, resistors 204 may be employed at various locations between LEDs 226 to vary the current flowing through particular LEDs. This is done to compensate for slight variations in individual LEDs, to set the brightness of the LEDs, or to match the string of LEDs to the supply voltage. "Trimmable" resistors may be employed instead of discrete resistors so that the resistors may be manufactured and placed in the circuit automatically. "Trimmable" resistors are preferably created by applying a higher resistance conductive ink in the path of the printed or silk screened conductive ink which provides the connection between LEDs 226, as discussed above. Preferably, the conductive ink used in the trimmable resistor will have a resistance of approximately 10Ω/cm, while the conductive ink used in the rest of the electrical trace between LEDs 226 has a resistance of approximately 0.01Ω/cm. If the trimmable resistors are created using conductive ink, the entire "circuitry" connecting LEDs 226 (i.e. both the connections between LEDs 226 and the resistors between those connections) may be printed or silk-screened onto substrate 200 for easy assembly. However, more conventional, discrete resistors placed in the path of the printed or silk-screened connections between LEDs 226 may also be used.

Trimmable resistors placed between LEDs 226 can be "trimmed," thereby changing their resistance and changing the current to individual LEDs. If the light intensity of the sign if uniform, the trimmable resistors can remain "untrimmed." However, if the light intensity is not uniform, particular resistors can be "trimmed" to even out the intensity over the entire sign. Trimmable resistors are well known to those of ordinary skill in the art. One of ordinary skill in the art will readily understand that a trimmable resistor may include a resistor with a "grid" of conductive connections. A combination of the conductive connections may be removed or "trimmed" to cause the flow of electricity to take a longer or shorter path as desired, thereby affecting the resistance applied to the current.

Another option for forming resistors 204, and for that matter all the circuit tracings, is to utilize electroless plating. A material having a fairly high resistance, such as carbon ink, may be used to form the "tracks" between successive LEDs 226. The carbon ink tracks are formed between LEDs 226 without leaving gaps or spaces for later insertion of resistors 204. Instead, portions of the carbon ink tracks are masked and the entire substrate assembly 205 is electrolessly plated with a suitable conductive material such as copper or nickel. Once the entire assembly has been plated, the masks are removed leaving a carbon ink resistor in the path of the more conductive copper or nickel track created by the plating. The copper or nickel will not adhere to the surfaces of LEDs 226 or substrate 200 because these surfaces are not conductive. The copper or nickel instead plates the carbon tracks between LEDs 226 (except for the masked portions) and the pins or posts which provide the electrical contacts for LEDs 226. This method ensures a good and rugged connection to LEDs 226 and a highly conductive path between LEDs 226.

Once LEDs 226, resistors 204, and connecting conductive ink 202 have been applied to substrate sheet 200, entire substrate-assembly 205 is positioned in housing 201—in this case, shaped as the letter "a", as shown in FIG. 11. Substrate 200 is supported away from and substantially parallel to, a rear wall 211 of housing 201 by support posts 246 which are mounted to rear wall 211, as shown in FIG. 12. As shown in FIG. 11, an edge 206 of substrate 200 is positioned between and substantially parallel to a front edge 208 and a back edge 210 of housing 201. As with previously discussed embodiments, LEDs 226 face toward rear wall 211, which is, itself, a diffuse reflector or which may be coated with a diffusely reflective layer (FIG. 12). FIG. 10, therefore, illustrates the light-emitting side of LEDs 226 and the face of substrate 200 which faces backwards (note the lower case "a" is backwards, thus illustrating a rearward view of substrate assembly 205). In contrast, FIG. 11 illustrates the front of substrate assembly 205 positioned within housing 201 with the light emitting side of LEDs 226 facing away from the viewer (note, here, the lower case "a" is forwards). After substrate assembly 205 has been positioned within housing 201, as depicted in FIG. 11, a translucent cover 232 (FIG. 12) formed in the shape of the desired sign (in this case, the letter "a"), is placed over housing 201, thereby enclosing housing 201. LEDs 246, then, emit light toward rear wall 211, which reflects the light back towards, and through, translucent cover or surface 232(see FIG. 12), thus illuminating the sign. A portion of rear wall 211 near back edge 210, or of the sidewall of housing 201 near back edge 210, may also be translucent to allow some light to pass there through creating a penumbra around the sign.

Figure 13A:
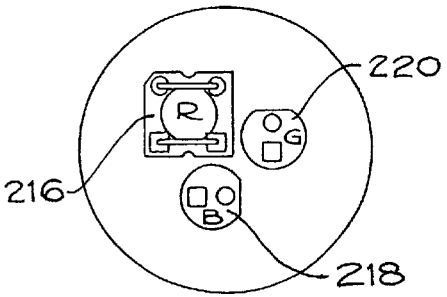
FIG. 13A is a magnified view of one pixel of the substrate of FIG. 13.
Figure 13:
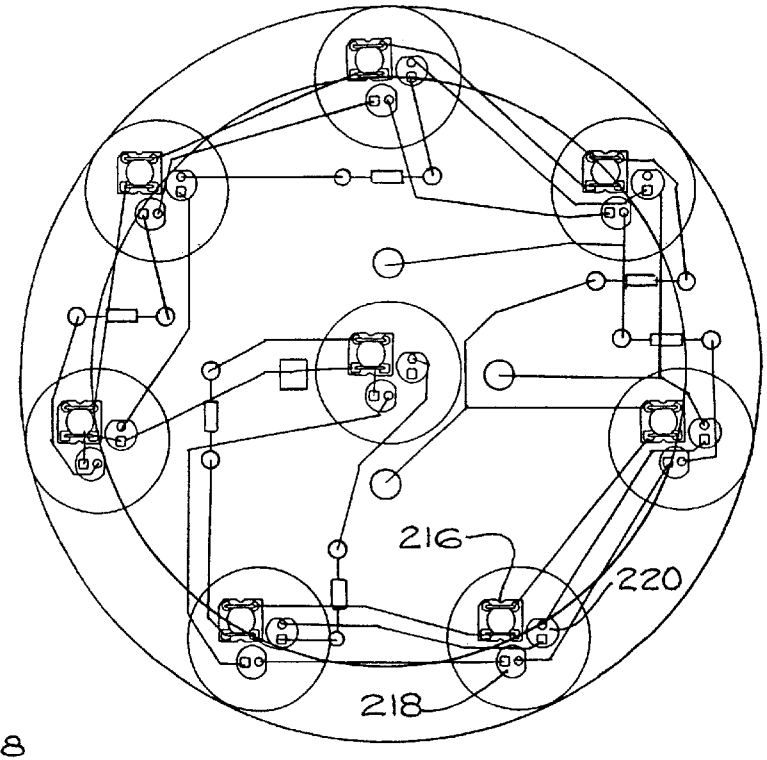
FIG. 13 is a top view of a substrate according to the present invention wherein different colored LEDs are grouped in pixels.
Figure 15:
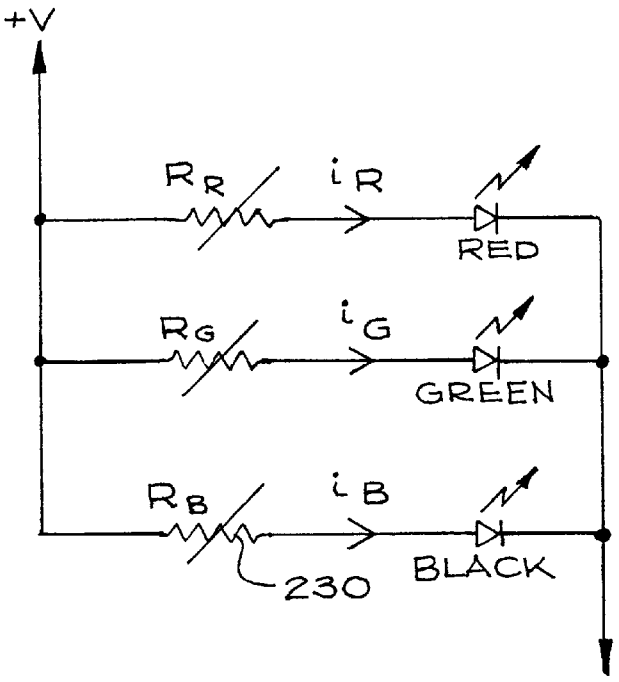
FIG. 15 is a circuit diagram illustrating one example of a controller for embodiments of the present invention, which utilize multiple colored LEDs.
Figure 14:
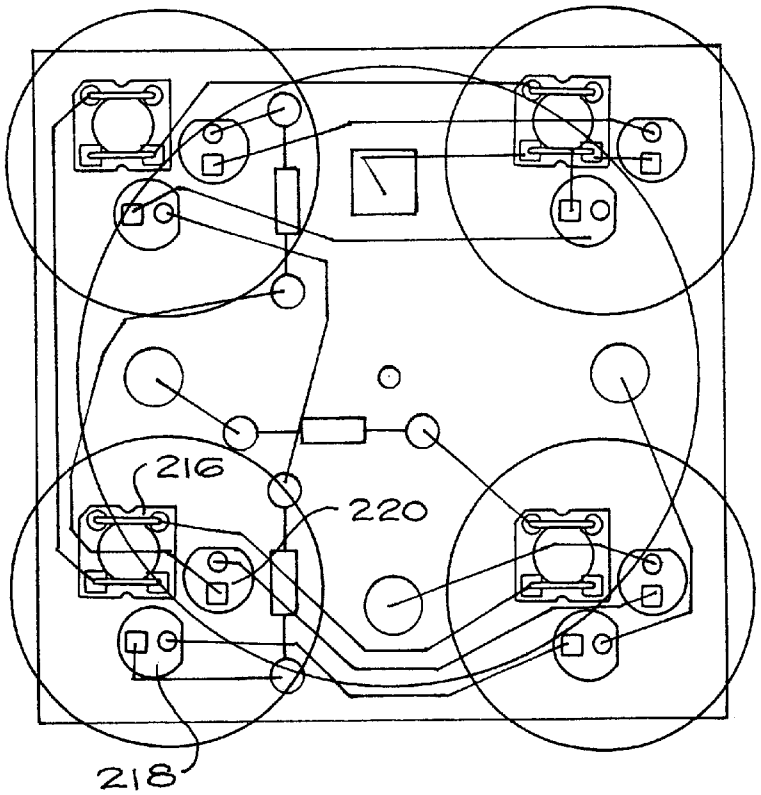
FIG. 14 is another embodiment of a sign according to the present invention similar to FIG. 13 wherein different colored LEDs are grouped in pixels.

Translucent cover or surface 232 will often be colored to give the sign a desired color. With a colored translucent cover or surface, LEDs 226 need only emit white light. The sign color will be governed by the color chosen for the translucent cover. Alternatively, as shown in FIGS. 13–15, and briefly discussed with reference to FIG. 8 above, red, blue, and green LEDs, 216, 218, and 220 respectively, can be grouped and, depending on the combination of the three LEDs 216, 218, and 220 lit, will produce various colors. For example, each of the red LEDs 216, shown in FIG. 13 or 14, may be lit while the blue and green LEDs 218, 220 remain unlit to produce a red colored sign. In an alternative example, each of the red and blue LEDs 216, 218 may be lit while the green LED 220 remains unlit to produce a purple colored sign (red and blue combine to make purple). In this way, a single colored translucent cover does not need to be chosen and instead the sign color can be changed without replacing sign parts.

One example of a controller which could be utilized to govern the color of a sign utilizing the multiple LED arrangement of FIG. 13 or 14 is illustrated in FIG. 15. FIG. 15 depicts a simple circuit, which allows a user to quickly and easily turn particular LEDs on and off, thereby producing various colors. It will be readily apparent to one of ordinary skill in the art that FIG. 15 illustrates merely one possible controller and that any number of arrangements for controlling red, blue, and green LEDs may alternatively be used. In FIG. 15, each LED of a selected color has a variable resistor or potentiometer 230 in series therewith to enable the current to the LED to be varied.

We claim:

1. An illuminated sign comprising:

a housing having a plurality of internal surfaces, wherein at least one of said internal surfaces is a translucent surface and at least one of the remaining internal surfaces is a diffusely-reflective surface;

a transparent substrate disposed within said housing; and at least one light emitting diode (LED) having an illumination field, said LED being positioned such that said illumination field is directed towards said diffusely-reflective surface, and said LED is interconnected with said transparent substrate.

2. The sign as set forth in claim 1, wherein the LED is connected in circuit to a power source by wire wrapping, spot welding or soldering.

3. The sign as set forth in claim 1, wherein said LED protrudes through said transparent substrate.

4. The sign as set forth in claim 1, wherein the transparent substrate is conformable into a plurality of designs thereby allowing the transparent substrate to accommodate the housing.

5. The sign as set forth in claim 1, wherein the transparent substrate is subdivided into first and second segments, and wherein an orientation of said first segment is changeable with respect to an orientation of said second segment, thereby allowing the substrate to conform to the housing.

6. The sign as set forth in claim 5, wherein the segments of the transparent substrate are interconnected by pivotable rivets.

7. The sign as set forth in claim 1, further comprising a conductive tracing on said substrate electrically connected to the LED.

8. The sign as set forth in claim 7, further comprising a resistor between said at least one LED and a second LED.

9. The sign as set forth in claim 8, wherein the resistor is a trimmable resistor.

10. The sign as set forth in claim 8, wherein the conductive tracings are formed of conductive ink.

11. The sign as set forth in claim 8, wherein the conductive tracings are formed of an electrolessly plated metal.

12. The sign as set forth in claim 8, wherein the resistor is formed of carbon ink.

13. The sign as set forth in claim 1, wherein said at least one LED comprises at least two LEDs connected in at least one of series and parallel and said two LEDs are supported by connection wires.

14. The sign as set forth in claim 1, wherein said at least one LED comprises multiple LEDs positioned such that the illumination field of each LED is substantially the same.

15. The sign as set forth in claim 14, wherein said multiple LEDs are grouped in pixels, each said pixel comprising a red, blue, and green LED.

16. The sign as set forth in claim 1, wherein the diffusely reflective surface is stretched polyethylene.

17. The sign as set forth in claim 1, wherein the diffusely reflective surface is flat finish paint.

18. The sign as set forth in claim 17, wherein the flat finish paint is titanium dioxide.

19. The sign as set forth in claim 1, wherein the illumination field is in the range from about 5° to about 60°.

20. The sign as set forth in claim 19, wherein the illumination field is about 45°.

21. The sign as set forth in claim 1, wherein the housing is subdivided into housing segments and wherein at least some of the housing segments contain at least one LED.

22. A method of illuminating a sign, the method comprising the acts of:

providing a housing having internal surfaces, wherein a first surface of the housing is translucent and at least one of said internal surfaces other than said translucent surface is diffusely reflective;

providing a transparent substrate;

interconnecting at least one LED to said transparent substrate, said at least one LED having an illumination field when active; and placing said transparent substrate within said housing such that said illumination field is substantially in the direction of said diffusely reflective surface, said placing act including conforming the transparent substrate to accommodate the housing.

23. The method as set forth in claim 22, further comprising the act of providing a power source and a conductive tracing, and connecting said LED in circuit to said power source using the conductive tracing.

24. The method as set forth in claim 22, further providing a power source and wherein the LED is connected in circuit to the power source by wire wrapping, spot welding, or soldering.

25. The method as set forth in claim 22, wherein said LEDs are connected in at least one of parallel or series and are supported by connection wires.

26. The method as set forth in claim 22, wherein multiple LEDs are positioned such that the illumination field of each LED is substantially the same.

27. The method as set forth in claim 22, wherein the reflective layer comprises stretched polyethylene.

28. The method as set forth in claim 22, wherein the reflective layer comprises a flat finish paint.

29. The method as set forth in claim 28, wherein the flat finish paint is titanium dioxide.

30. The method as set forth in claim 22, wherein the illumination field is in the range from about 5° to about 60°.

31. The method as set forth in claim 30, wherein the illumination field is about 45°.

32. The method as set forth in claim 22, wherein the transparent substrate is subdivided into first and second segments, and wherein the method further comprises changing an orientation of said first segment with respect to an orientation of said second segment.

33. The method as set forth in claim 22, wherein the housing is subdivided into housing segments and at least one housing segment contains at least one LED.

34. The sign as set forth in claim 1, wherein said LED is positioned between said translucent surface and said diffusely reflective surface, and wherein said illumination field is in a direction substantially opposite said translucent surface.

35. The method as set forth in claim 22, wherein said illumination field is in a direction substantially opposite to said translucent surface.

36. The sign as set forth in claim 1, wherein each of said internal surfaces other than said translucent surface is diffusely reflective, and wherein the transparent substrate is spaced from the translucent surface.

37. The method as set forth in claim 22, wherein said illumination field is substantially in the direction opposite of said translucent surface wherein said placing act includes spacing said transparent substrate from the translucent surface.

* * * * *